US009589429B2

(12) United States Patent
Sun

(10) Patent No.: US 9,589,429 B2
(45) Date of Patent: Mar. 7, 2017

(54) ALARM DETECTOR

(71) Applicant: SIEMENS AKTIENGESELLSCHAFT, München (DE)

(72) Inventor: Chang Lin Sun, Beijing (CN)

(73) Assignee: SIEMENS SCHWEIZ AG, Zurich (CH)

( * ) Notice: Subject to any disclaimer, the term of this patent is extended or adjusted under 35 U.S.C. 154(b) by 0 days.

(21) Appl. No.: 14/093,283

(22) Filed: Nov. 29, 2013

(65) Prior Publication Data

US 2014/0240107 A1 Aug. 28, 2014

(30) Foreign Application Priority Data

Feb. 28, 2013 (CN) ..... 2013 1 0064993

(51) Int. Cl.
*G08B 3/10* (2006.01)
*G08B 17/113* (2006.01)
*G08B 17/00* (2006.01)

(52) U.S. Cl.
CPC ..... *G08B 3/10* (2013.01); *G08B 17/113* (2013.01); *G08B 17/00* (2013.01)

(58) Field of Classification Search
CPC ..... G08B 17/00; G08B 3/10; G08B 25/009; G08B 17/10; G08B 25/14; G08B 7/06; G08B 25/016; H04M 11/04
USPC ..... 340/384.1, 384.7, 384.73
See application file for complete search history.

(56) References Cited

U.S. PATENT DOCUMENTS 3,590,941 A * 7/1971 McKenzie ..... H04R 1/2857 181/145
3,995,125 A * 11/1976 Cypser ..... H04R 1/023 381/391
6,905,001 B1 * 6/2005 Runciman ..... G10K 9/20 181/187

FOREIGN PATENT DOCUMENTS

BE 1019197 4/2012
BE 1019197 A3 4/2012 ..... G08B 3/10
CN 2749014 12/2005
CN 101324977 12/2008
WO WO 2011112698 A2 * 9/2011

OTHER PUBLICATIONS

Chinese Search Report issued in corresponding Chinese Patent Application No. 2013100649934.
Chinese Office Action, Application No. 201310064993.4, 14 pages, Nov. 1, 2016.

* cited by examiner

*Primary Examiner* — James Yang
(74) *Attorney, Agent, or Firm* — Slayden Grubert Beard PLLC

(57) ABSTRACT

An alarm sounder and at least one sound amplification component having at least one horn shaped channel form an alarm detector. The at least one horn shaped channel has a throat end and an outlet end, the throat end being disposed corresponding to a sound-making end of the alarm sounder. The sound intensity of the alarm detector can meet the regulations of the industry standards.

8 Claims, 5 Drawing Sheets

ALARM DETECTOR

CROSS REFERENCE TO RELATED APPLICATIONS

This application is based on and hereby claims priority to Chinese Application No. 201310064993.4 filed on Feb. 28, 2013, the contents of which are hereby incorporated by reference herein in their entirety.

BACKGROUND

Technical Field

The field is safety precaution, and in particular, alarm detector.

Background Art

An alarm detector is, as a sensing and detecting device, used for detecting various abnormal situations as well as the intrusion behavior of an intruder. A number of locations in a variety of intelligent buildings and general buildings are in need of safety precaution, and these locations have a variety of purposes and requirements of safety precaution according to actual situations. Therefore, there exists a need for a variety of alarm detectors, such as a smoke detector, a temperature detector, a special gas detector and an intrusion detector and the like, to meet different requirements of safety precaution.

An alarm detector generally includes a sensor, a sensor base, a circuit board (such as a PCB circuit board) and a circuit cover plate. In this case, the sensor is a sensing device of the alarm detector, and the circuit board is a signal processing device of the alarm detector. The circuit board is provided with an alarm sounder for alarming.

The current alarm detectors usually use a buzzer as an alarm sounder, and some may use a speaker in place of a buzzer as the alarm sounder. However, no matter what kind of alarm detector is used, the sound intensity thereof is usually limited by a specific component and will not reach a higher volume; therefore, for some applications with special requirements, for example, waking up people in deep sleep by an alarm sound, etc., this may not be enough to meet these requirements.

SUMMARY

In view of this, the alarm detector improves the sound intensity of the alarm detector.

The alarm detector is includes an alarm sounder having a sound-making end; and a sound amplification component having at least one horn channel, the at least one horn channel having a throat end and an outlet end, wherein the throat end is disposed corresponding to the sound-making end of the alarm sounder.

In an embodiment, each of the horn channels is disposed to extend along a radial direction perpendicular to an axis of the alarm detector, and is in a horn shape in a radial section. The at least one horn channel may be a cavity formed around the axis of the alarm detector. Optionally, the sound amplification component has a multiplicity of horn channels, the multiplicity of horn channels forming a plurality of cavities, such as a plurality of fan-shaped cavities, distributed around the axis of the alarm detector.

In an embodiment, the outlet end of each of the horn channels is provided with a plurality of grilles to divide the outlet end of the horn channel into a plurality of sub-outlets. Each sub-outlet may have a horn shape.

In an embodiment, the sound amplification component has a plurality of horn channels, the plurality of horn channels being uniformly or non-uniformly distributed around the axis of the alarm detector.

In an embodiment, the alarm sounder is a buzzer or a speaker.

In an embodiment, the alarm detector includes a fire alarm.

It can be seen from the above-mentioned solutions that since in the embodiments of a sound amplification component having at least one horn shaped channel is disposed at a sound-making end of an alarm sounder in an alarm detector, and a throat end of the horn shaped channel of the sound amplification component is made to correspond to the sound-making end of the alarm sounder, the sound intensity of the alarm sounder can be improved. Further, the sound intensity of the alarm detector in the embodiments can also meet the regulations of the industry standards.

Furthermore, in the embodiments, an outlet end of a large horn channel is provided with a plurality of grilles such that the outlet end forms a plurality of sub-outlets, with each of the sub-outlets being in a horn shape, so that the sound intensity of an alarm detector can be further improved.

BRIEF DESCRIPTION OF THE DRAWINGS

These and other features and advantages will be more apparent and more readily appreciated from the following description of the exemplary embodiments, taken in conjunction with the accompanying drawings of which:

FIG. 1*a* is a full sectional view of a front view, FIG. 1*b* is a perspective top view, and FIG. 1*c* is a perspective bottom view.

FIG. 2*a* is a full sectional view of a front view, FIG. 2*b* is a perspective top view, FIG. 2*c* is a perspective bottom view, and FIG. 2*d* is a partially enlarged plan view of an outlet end of the sound amplification component.

FIG. 3*a* is a full sectional view of a front view, FIG. 3*b* is a top view, and FIG. 3*c* is a bottom view.

FIG. 4*a* is a full sectional view of a front view, FIG. 4*b* is a perspective top view, and FIG. 4*c* is a perspective bottom view.

Figure 1A:
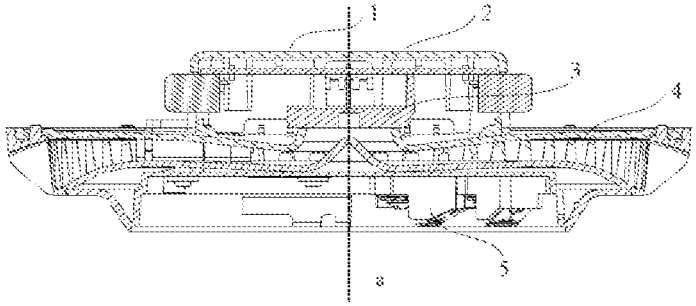
FIGS. 1*a* to 1*c* are structural schematic representations of an alarm detector in a first embodiment.

In these figures, reference signs are as follows:

| Reference number | Meaning |
|---|---|
| 1, 6 | circuit cover plate |
| 2, 7 | circuit board |
| 3 | buzzer |
| 8 | speaker |
| 4, 9 | sound amplification component |
| 5, 10 | sensor base |
| 41, 91 | first cover plate |
| 42, 92 | second cover plate |
| 43, 93 | grille |
| 44, 94 | positioning plate |
| 45, 95 | first mounting pin |

-continued

| Reference number | Meaning |
|---|---|
| 46, 96 | second mounting pin |
| 4A, 9A | throat end |
| 4B, 9B | outlet end |

DETAILED DESCRIPTION OF THE PREFERRED EMBODIMENT

Reference will now be made in detail to the preferred embodiments, examples of which are illustrated in the accompanying drawings, wherein like reference numerals refer to like elements throughout.

In embodiments, to improve the sound intensity of an alarm sounder of an alarm detector, taking into account the principle of a horn, at least one sound amplification component having at least one horn channel is disposed at a sound-making end of an alarm sounder, and a throat end of the horn channel of the sound amplification component is made to correspond to a sound-making end of the alarm sounder, thereby improving the sound intensity of the alarm sounder, so that the sound intensity of the alarm detector can meet the regulations of the industry standards.

First Embodiment

Figure 1B:
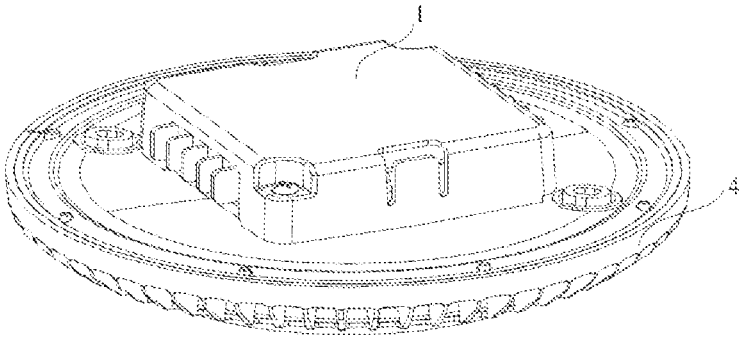
Figure 1C:
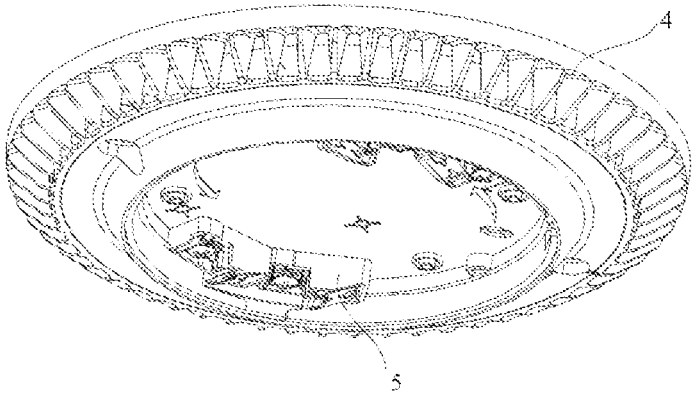
Figure 2A:
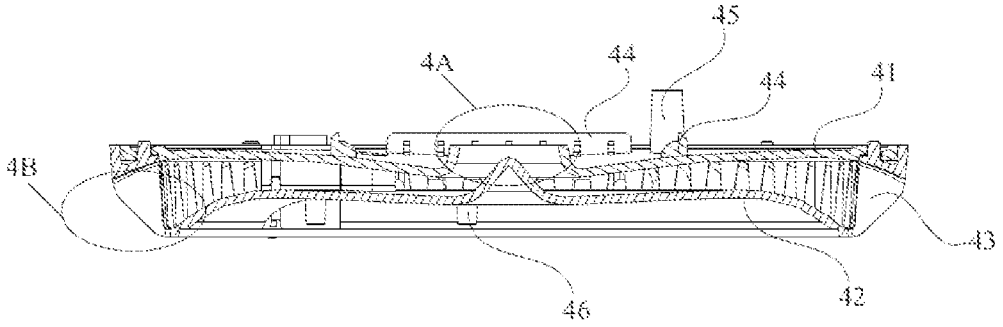
FIGS. 2*a* to 2*d* are structural schematic representations of a sound amplification component in the alarm detector shown in FIG. 1*a* to FIG. 1*c*.
Figure 2B:
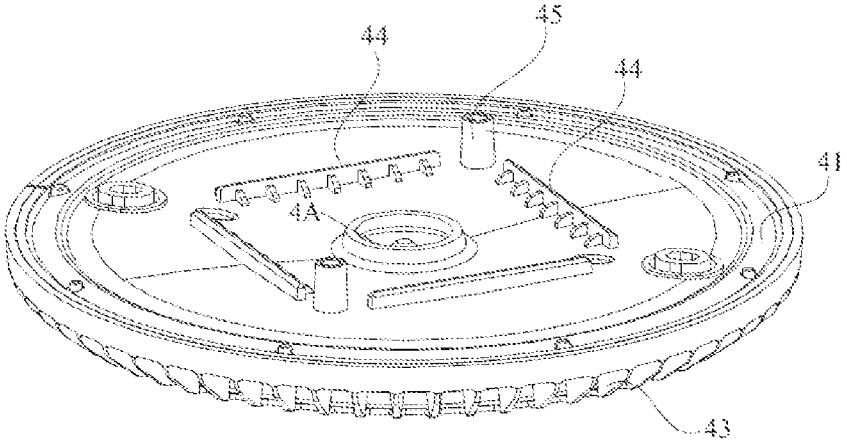
Figure 2C:
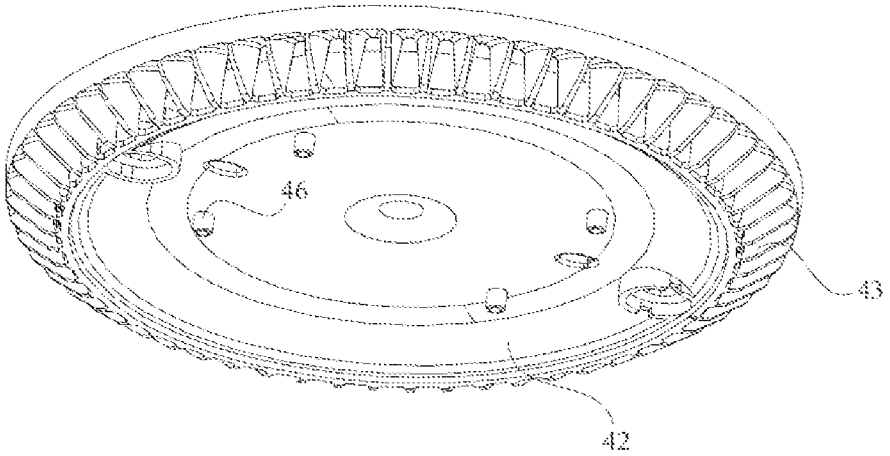
Figure 2D:
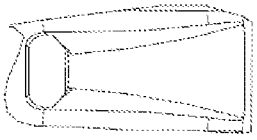

FIGS. 1*a* to 1*c* are structural schematic representations of an alarm detector in a first embodiment. FIG. 1*a* is a full sectional view of a front view, FIG. 1*b* is a perspective top view, and FIG. 1*c* is a perspective bottom view. FIGS. 2*a* to 2*d* are structural schematic representations of a sound amplification component in the alarm detector shown in FIGS. 1*a* to 1*c*. FIG. 2*a* is a full sectional view of a front view, FIG. 2*b* is a perspective top view, FIG. 2*c* is a perspective bottom view, and FIG. 2*d* is a partially enlarged plan view of an outlet end of the sound amplification component. Unless specifically explained, the orientations, such as upper, lower, left, right and so on, involved in the descriptive embodiments to facilitate the explanation, are all based on the viewing angle shown in FIG. 1*a*.

As shown in FIG. 1*a* to FIG. 2*d*, the alarm detector includes: a circuit cover plate 1, a circuit board 2, a buzzer 3 mounted on the circuit board 2, a sound amplification component 4 and a sensor base 5. Furthermore, the alarm detector can also include a sensor (not shown).

In a specific implementation, the sound amplification component 4 can be implemented in a multiplicity of specific structures, and it may have only one horn channel, or may have more than one horn channel. Each of the horn channels has a throat end 4A, an outlet end 4B and a channel body therebetween. In the figures, the throat end 4A is formed of, for example, two horn shaped throat ends distributed symmetrically in a section. Furthermore, there can be one or multiple sound amplification components 4. When there are multiple sound amplification components 4, they may be uniformly distributed, or may be non-uniformly distributed, as long as the throat end of the horn channel of the sound amplification component 4 corresponds to a sound-making end of the buzzer 3.

When the sound amplification component has a multiplicity of horn channels, each of the horn channels can be disposed to extend along a radial direction perpendicular to an axis A of the alarm detector as shown in FIG. 1*a*, and have a horn shape in a radial section. For example, the radial section is similar to that shown in FIG. 2*a*. The multiplicity of horn channels are separate from one another, and can be uniformly distributed or non-uniformly distributed around the axis A. As shown in FIG. 2*a*, an alarm sounder can be disposed, for example, on the axis, the throat end 4A of each of the horn channels corresponds to a sound-making end of the alarm sounder 3, and each of the horn channels is distributed along a radial direction perpendicular to the axis A, and thus the outlet end thereof is formed near the edge of the alarm detector.

In the first embodiment, the horn channel of the sound amplification component 4 is a cavity distributed continuously around the axis A as shown in FIGS. 2*a* to 2*d*, and any radial section of the cavity is in a horn shape. Of course, in other embodiments, the horn channel of the sound amplification component 4 can also be a multiplicity of cavities, such as two semi-circular cavities (or semi-annular cavities) or a plurality of fan-shaped cavities, etc. The radial section of each of the cavities is in a horn shape as shown in FIG. 2*a*. Furthermore, the sound amplification component 4 can also be in other horn structures, which are not listed here individually.

In a specific implementation, the sound amplification component 4 can be integrally formed, and can also be assembled from different constituent parts as shown in FIG. 2*a* to FIG. 2*d*. As shown in FIG. 2*a* to FIG. 2*d*, the sound amplification component 4 in the first embodiment includes a first cover plate 41 (an upper cover plate in the viewing angle as shown in FIG. 2*a*), a second cover plate 42 (a lower cover plate in the viewing angle as shown in FIG. 2*a*) and a bracket 43 supported between the first cover plate 41 and the second cover plate 42. Between the first cover plate 41 and the second cover plate 42 is formed a horn channel. In a particular embodiment, the first cover plate 41, the bracket 43 and the second cover plate 42 can be connected together by riveting, bolt-and-nut connection or welding, etc., for example without limitation.

In a specific implementation, the bracket 43 can be a simple, small bracket which only serves for supporting, can also be a grille bracket composed of a plurality of small grilles as shown in FIGS. 2*a* to 2*d*, and can also have a plurality of small grilles disposed independently.

In a specific implementation, in the case of a plurality of grilles being provided, these grilles can be small grilles only located at the outlet end of the horn channel as shown in FIGS. 2*a* to 2*d*, for dividing the outlet end of the horn channel into a plurality of sub-outlets. Further, the small grilles located at the outlet end of the horn channel can, as shown in FIGS. 2*a* to 2*d*, have a structure for making each of the sub-outlets horn-shaped, the horn shape also being called a micro horn. Reference can be particularly made to FIG. 2*d*, the throat end of the micro horn being shown on the left side of FIG. 2*d*, and the outlet end of the micro horn being shown on the right side. The sound intensity of an alarm detector can be further improved by these micro horns.

Besides the structure of the micro horn as shown in FIGS. 2*a* to 2*d*, in other embodiments of the present utility model, the micro horn can also be implemented in other specific structures, which are not listed here individually.

Furthermore, these grilles can also be a large grille passing through an entire horn channel, for dividing a single large horn channel as shown in FIG. 2*a* into a plurality of horn channels.

In the first embodiment, the first cover plate 41 of the sound amplification component 4 is provided with a fitting member for fitting with the circuit cover plate 1, such as a positioning plate 44 and a first mounting pin 45 as shown in FIGS. 2*a* to 2*d*. Furthermore, the second cover plate 42 of the sound amplification component 4 is also provided with a fitting member for fitting with the sensor base 5, such as a second mounting pin 46 as shown in FIGS. 2*a* to 2*d*.

Of course, for different alarm detectors, the structure of the sound amplification component 4 and the connection structure thereof to other components vary correspondingly, and are not limited to the specific structures as shown in FIGS. 2*a* to 2*d*.

Second Embodiment

Figure 3A:
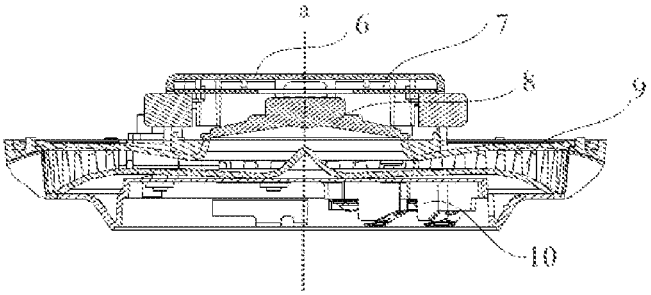
FIGS. 3*a* to 3*c* are structural schematic representations of an alarm detector in a second embodiment.
Figure 3B:
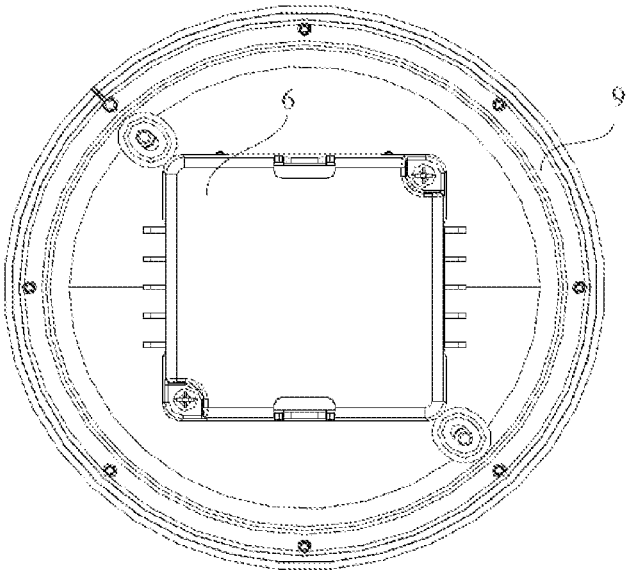
Figure 3C:
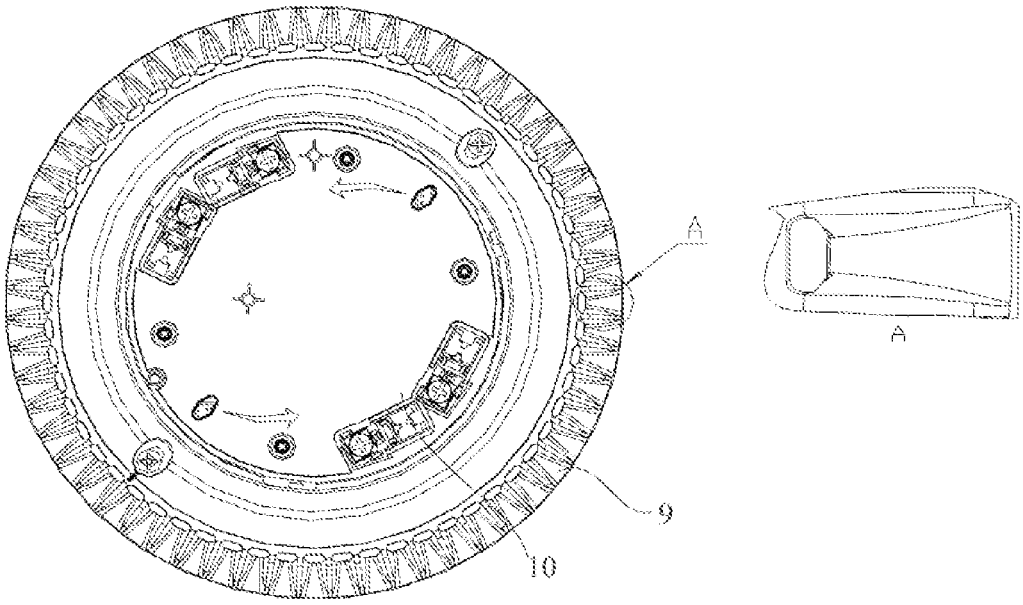
Figure 4A:
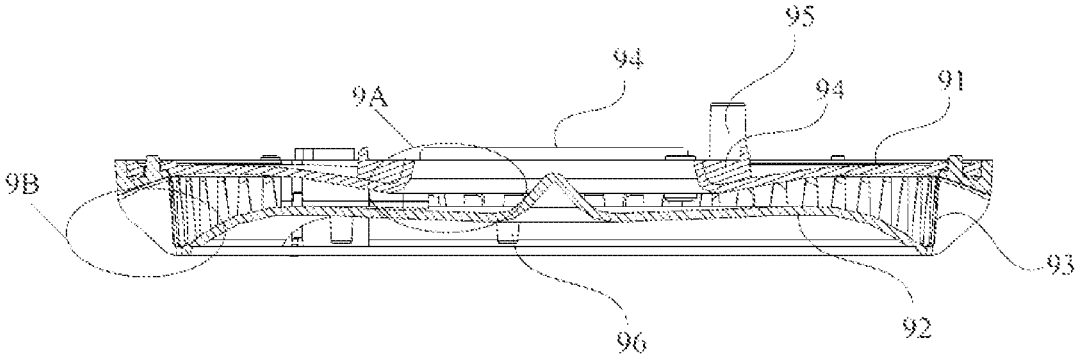
FIGS. 4*a* to 4*c* are structural schematic representations of a sound amplification component in the alarm detector shown in FIGS. 3*a* to 3*c*.
Figure 4B:
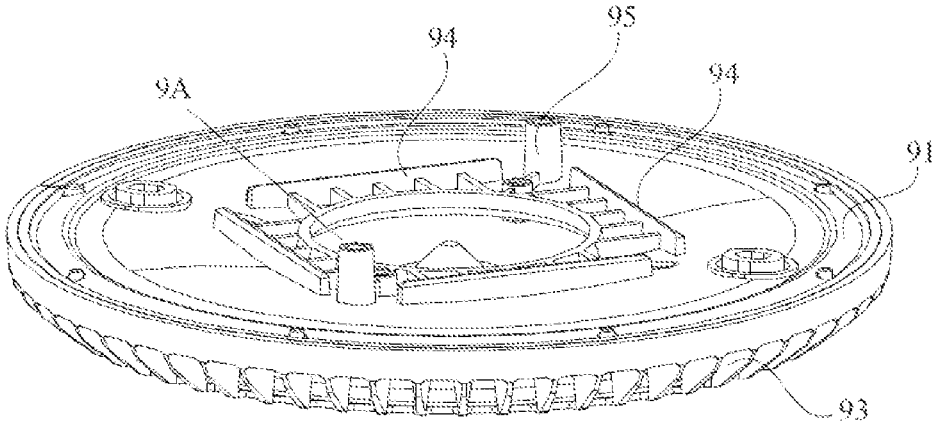
Figure 4C:
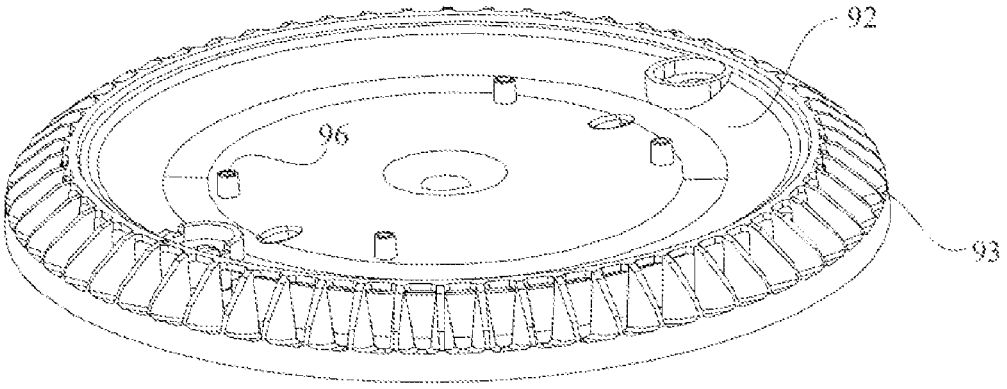

FIGS. 3*a* to 3*c* are structural schematic representations of an alarm detector in a second embodiment. FIG. 3*a* is a full sectional view of a front view, FIG. 3*b* is a top view, and FIG. 3*c* is a bottom view. FIGS. 4*a* to 4*c* are structural schematic representations of a sound amplification component in the alarm detector as shown in FIGS. 3*a* to 3*c*. FIG. 4*a* is a full sectional view of a front view, FIG. 4*b* is a perspective top view, and FIG. 4*c* is a perspective bottom view.

As shown in FIGS. 3*a* to 4*c*, the alarm detector includes: a circuit cover plate 6, a circuit board 7, a speaker 8 mounted on the circuit board 7, a sound amplification component 9 and a sensor base 10. Furthermore, the alarm detector can also include a sensor (not shown).

Similarly to the alarm detector as shown in FIGS. 1*a* to 2*c*, the sound amplification component 9 in the second embodiment can also be implemented in a multiplicity of specific structures, and it may have only one horn channel, or may have more than one horn channel. Each of the horn channels has a throat end 9A, an outlet end 9B and a channel body therebetween. Furthermore, there can be one or multiple sound amplification components 9. When there are multiple sound amplification components 9, they can be uniformly distributed, and can also be non-uniformly distributed, as long as the throat end of the horn channel of the sound amplification component 9 corresponds to a sound-making end of the speaker 8.

In the second embodiment, the horn channel of the sound amplification component 9 is an annular cavity as shown in FIGS. 4*a* to 4*c*, and any radial section of the annular cavity is in a horn shape. Of course, in other embodiments, the horn channel of the sound amplification component 9 can also be two semi-annular cavities or a plurality of fan-shaped cavities, etc., and any radial section of the semi-annular cavities or fan-shaped cavities is in a horn shape. Furthermore, the sound amplification component 9 can also be in other horn structures, which are not listed here individually.

In a specific implementation, the sound amplification component 9 can be integrally formed, and can also be assembled from different constituent parts as shown in FIGS. 4*a* to 4*c*. As shown in FIGS. 4*a* to 4*c*, the sound amplification component 9 in the second embodiment includes a first cover plate 91 (an upper cover plate in the viewing angle shown in FIG. 4*a*), a second cover plate 92 (a lower cover plate in the viewing angle shown in FIG. 4*a*) and a bracket 93 supported between the first cover plate 91 and the second cover plate 92. Between the first cover plate 91 and the second cover plate 92 is formed a horn channel. In a particular embodiment, the first cover plate 91, the bracket 93 and the second cover plate 92 can be connected together by riveting, bolt-and-nut connection or welding, etc., which are not described here.

In a specific implementation, the bracket 93 can be a simple, small bracket which only serves for supporting, can also be a grille bracket composed of a plurality of small grilles as shown in FIGS. 4*a* to 4*c*, and can also be a plurality of small grilles disposed independently.

In a specific implementation, in the case of a plurality of grilles being provided, these grilles can be small grilles only located at the outlet end of the horn channel as shown in FIGS. 4*a* to 4*c*, for dividing the outlet end of the horn channel into a plurality of sub-outlets. Further, the small grilles located at the outlet end of the horn channel can, as shown in FIGS. 3*a* to 4*c*, have a structure for making each of the sub-outlets micro-horn-shaped. Reference can be particularly made to a partially enlarged view A of FIG. 3*c*, the throat end of the micro horn being shown on the left side of the partially enlarged view, and the outlet end of the micro horn being shown on the right side. The sound intensity of an alarm detector can be further improved by these micro horns.

Besides the structure of the micro horn as shown in FIGS. 4*a* to 4*c*, in other embodiments of the present utility model, the micro horn can also be implemented in other specific structures, which are not listed here individually.

Furthermore, these grilles can also be a large grille passing through an entire horn channel, for dividing a single horn channel into a plurality of sub-horn channels.

In the second embodiment, the first cover plate 91 of the sound amplification component 9 is provided with a fitting member for fitting with the circuit cover plate 1, such as a positioning plate 94 and a first mounting pin 95 as shown in FIGS. 4*a* to 4*c*. Furthermore, the second cover plate 92 of the sound amplification component 9 is also provided with a fitting member for fitting with the sensor base 10, such as a second mounting pin 96 as shown in FIGS. 4*a* to 4*c*.

Of course, for different alarm detectors, the structure of the sound amplification component 9 and the connection structure thereof to other components vary correspondingly, and are not limited to the specific structures as shown in FIGS. 4*a* to 4*c*.

Furthermore, in a specific implementation, the sound amplification components in the first and second embodiments can also be a plurality of horn structures uniformly or non-uniformly distributed and having at least one horn shaped channel.

The alarm detector includes a fire alarm, etc. The fire alarm includes: a smoke detector, a temperature detector, a special gas detector, etc.

In the embodiments, since at least one sound amplification component having at least one horn shaped channel is disposed at a sound-making end of an alarm sounder of an alarm detector, and a throat end of the horn shaped channel of the sound amplification component is made to correspond to the sound-making end of the alarm sounder, the sound intensity of the alarm sounder can be improved.

Furthermore, some standards, such as the UL217 & UL464 standards, require that the sound intensity of an alarm detector is not less than 85 dB in a space with an echo, and require that the sounding frequency thereof reaches 520 Hz and has a certain waveform structure, so that people in deep sleep can be woken up by an alarm sound of the alarm detector. In another example, the ULC-S541 standard requires that the sound intensity of an alarm detector is not less than 85 dB in a space without an echo, but has no requirement for a sounding frequency of 520 Hz. For the second standard mentioned above, in a current alarm detector, a buzzer is usually used as an alarm sounder, but the sound intensity of the alarm detector while using a buzzer is generally not up to 85 dB, and the sound intensity of some products can only reach 83 dB at most. However, when the alarm detector in the first embodiment is used, the sound intensity can usually further meet the regulations of the industry standards. For the first standard mentioned above, since when using a buzzer an alarm detector cannot meet the requirements of the UL217 & UL464 standards for a frequency of 520 Hz and a waveform structure, a speaker in place of a buzzer is used as an alarm sounder in a current alarm detector; although when using a speaker an alarm detector can meet the requirements of the UL217 & UL464 standards for a frequency of 520 Hz and a waveform structure, the sound intensity still cannot meet the requirement of the above-mentioned standard for 85 dB, and is even lower than the sound intensity when a buzzer is used. However, when the alarm detector in the second embodiment is used, the sound intensity thereof can usually further meet the regulations of the industry standards.

Stated above are merely embodiments, without intending to limit the present invention; any modification, equivalent replacement, improvement, etc., made within the spirit and principle of the present invention, should be encompassed within the spirit and scope of protection of the claims which may include the phrase "at least one of A, B and C" as an alternative expression that means one or more of A, B and C may be used, contrary to the holding in *Superguide v. DIRECTV,* 358 F3d 870, 69 USPQ2d 1865 (Fed. Cir. 2004).

What is claimed is:

1. An alarm detector base, comprising:

an alarm sounder, having a sound-making end; and a sound amplification component having at least one horn channel, the at least one horn channel including a throat end and an outlet end, the throat end disposed corresponding to the sound-making end of said alarm sounder, wherein each horn channel is disposed to extend along a radial direction perpendicular to an axis of said alarm detector base, and is in a horn shape on a radial section, and a plurality of grills located at the outlet end of each horn channel to divide the outlet end of the respective horn channel into a plurality of sub-outlets, wherein each sub-outlet defined by a respective grill has a horn shape providing a straight-line path through the respective grill along the radial direction and having (a) a first width in a first direction perpendicular to the radial direction and (b) second width in a second direction perpendicular to the first direction and tangential to the radial direction, wherein both the first width and second width of the respective sub-outlet increase along the radial direction from an inlet end of the sub-outlet to an outlet end of the sub-outlet to amplify sound from the alarm sounder.

2. The alarm detector base as claimed in claim 1, wherein said at least one horn channel is a cavity formed around the axis of said alarm detector base.

3. The alarm detector base as claimed in claim 1, wherein said alarm detector has an axis, and wherein said sound amplification component includes a plurality of horn channels uniformly or non-uniformly distributed around the axis of said alarm detector base.

4. The alarm detector base as claimed in claim 1, wherein said alarm sounder is a buzzer or a speaker.

5. The alarm detector base as claimed in claim 1, wherein said alarm detector base further comprises a fire alarm.

6. The alarm detector base as claimed in claim 1, wherein said alarm detector base further comprising a sensor plate with a set of contacts to receive an alarm detector.

7. The alarm detector base as claimed in claim 1, wherein said sound amplification component includes a multiplicity of horn channels forming a multiplicity of cavities distributed around the axis of said alarm detector base.

8. The alarm detector base as claimed in claim 1, wherein said sound amplification component has a single horn channel extending fully around a circumference of the alarm detector base.

* * * * *